United States Patent [19]

Pecheux

[11] 4,323,060

[45] Apr. 6, 1982

[54] SPLINT

[76] Inventor: Jean-Claude R. Pécheux, 55, Avenue d'Arches, Charleville-Mézières, France, 08000

[21] Appl. No.: 141,405

[22] Filed: Apr. 18, 1980

[30] Foreign Application Priority Data

Apr. 23, 1979 [FR] France ..... 79 11181
Nov. 5, 1979 [FR] France ..... 79 27622

[51] Int. Cl.[3] ..... A24C 5/18
[52] U.S. Cl. ..... 128/84 R; 128/75
[58] Field of Search ..... 128/84, 84 C, 85, 88, 128/71, 75

[56] References Cited

U.S. PATENT DOCUMENTS 3,066,322 12/1962 Derby ..... 128/88 UX
3,135,257 6/1964 Anderson ..... 128/84 R
3,616,795 11/1971 Powcan ..... 128/85
3,661,150 5/1972 Peterssen et al. ..... 128/85
3,765,411 10/1973 Ward, Jr. ..... 128/84 C
3,800,787 4/1974 Rush ..... 128/84 R X
3,878,842 4/1975 Goldberg ..... 128/84 C

FOREIGN PATENT DOCUMENTS 297482 8/1915 Fed. Rep. of Germany .

*Primary Examiner*—Stephen C. Pellegrino
*Attorney, Agent, or Firm*—Bacon & Thomas

[57] ABSTRACT

The present invention relates to orthopaedic equipment, and particularly a splint, comprising an articulated assembly associated with a drive member for provoking the relative angular displacement, on the one hand, between articulated sections constituting the assembly and, on the other hand, between said assembly and a support frame, at least one of the sections being extended by a frame supporting an independent traction equipment comprising a traction member, a traction circuit and a traction stirrup. The invention is more particularly applicable to the reeducation of lower limbs.

15 Claims, 14 Drawing Figures

20
44
41
43
42
53
47
24
5
22
17
15
14
16
15
18
18
48
49
55
54
46
25
23
6
1
2
10
7
8
9
8
11
12
13
14
18
58
49
56
57
50
8
7

Fig-12
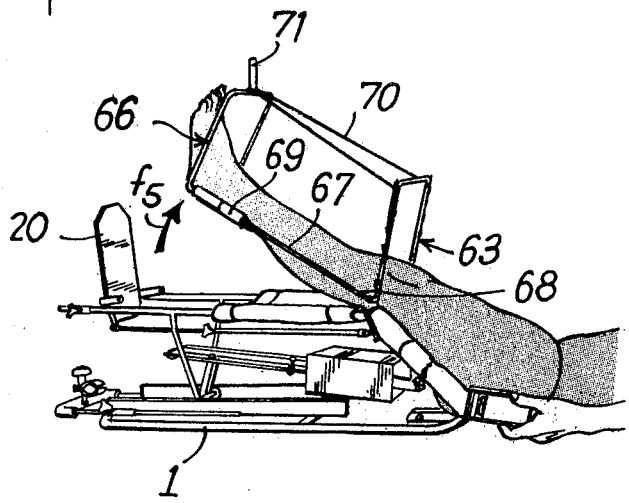
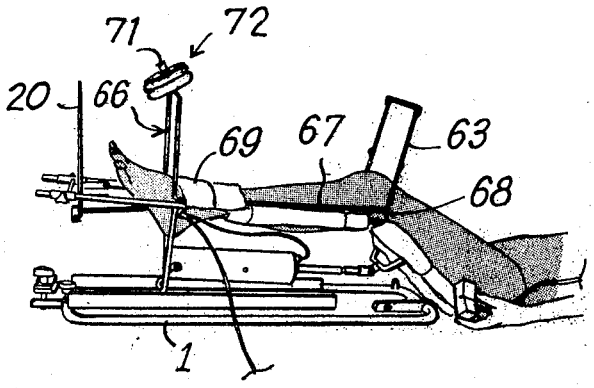
Fig-13
Fig-14
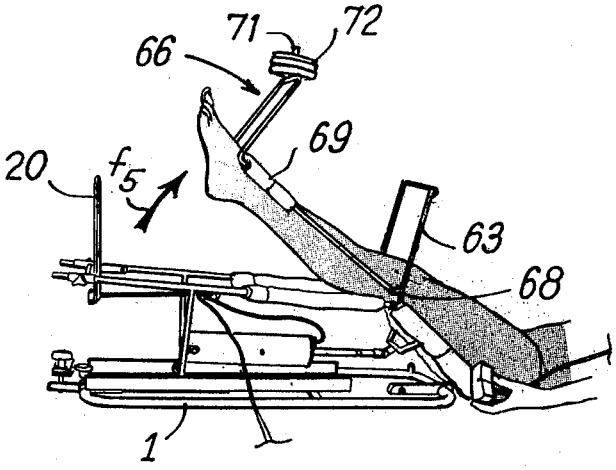

SPLINT

The present invention relates to the medical domain and more particularly to the equipment used for orthopaedic treatment or functional reeducation of the lower limbs.

To this end, the proposed equipment is generally constituted by a splint comprising a femoral cradle connected by an articulation to a tibial cradle which is most often equipped, like the femoral cradle, with a hammock for receiving and supporting the corresponding part of the limb to be supported.

Splints may be classified in different types according to their design and the possibilities that they offer.

A first type is intended to rest on a support plane such as a bed. These splints comprise a metal frame forming support and rest base and carrying, by various means, a femoral section and a tibial section articulated to each other by an articulation with locking means materialising the knee joint in the case of application to a lower limb. The device for locking the articulation makes it possible to choose and adjust the relative angulation between, on the one hand, the femoral and tibial sections, and, on the other hand, between the femoral portion and the support frame and consequently to define the positioning of the limb to be supported. Such splints may be equipped with cradles provided with pulleys intended for guiding cables, cords or other traction members connected to stirrups capable of being placed on the limb, so as to effect either a cutaneous traction along the femoral or tibial axis or a transosseous traction by transfemoral, transtibial or transcalcaneal pin, using a counterweight acting on said cable.

Such splints therefore enable the preadjusted immobilisation of a limb to be effected by subjecting it, or not, to an effect of traction without using any structure other than that of the splint.

A second type is intended to ensure the suspension of a limb and, to this end, such splints are constituted by a femoral section and a tibial section provided with rest hammocks, articulated to each other at the axis materialising the knee joint and suspended by cradles from a suspension frame or crossbeam independent of the splint and forming part either of the bed structure or frame, or of a structure added thereto.

The suspension may be of the simple or balanced type, i.e. using ropes, pulleys and counterweights, and possibly elastic rollers.

Suspended splints of the above type allow suspension or suspended positioning, as well as possible mobilisation, employing, in the latter case, a traction circuit with additional pulleys set up on the suspension structure.

The splints of this second type consequently have the advantage over the splints of the first type, of allowing an active or passive mobilisation of the supported limb, but, on the other hand, they have the drawback of not allowing a possible independent traction.

It is an object of the present invention to combine the advantages of the two types of known splints whilst eliminating the drawbacks of each of them and, to this end, it relates to a new splint of the supported type, more particularly designed to render possible a positioning of the limb, a possible mobilisation, an independent traction and a possibility of mobilisation under traction.

The design of the splint of the invention is particularly chosen for these different possibilities to be attained using simple technical means which are of relatively small dimensions, which do not add any further servitude for the patient and which allow a rapid transformation when it is necessary to seek and carry out one or more of the possibilities offered.

The particular design of the splint of the invention is further chosen so that it is possible for several of the functions of the splint to be performed simultaneously, without one of these functions having a detrimental influence on the performance of another or modifying the performance of a concomitant function.

It is a further object of the invention to provide, for a splint of the above-mentioned type, means making it possible, in the course of the same movement in flexion-extension, to make the coxofemoral articulation, the knee joint, and the ankle joint work simultaneously, if this is desired, giving the latter an amplitude of articulation which may be adjusted independently of the amplitude of flexion and extension of the knee joint.

It is a further object of the invention to provide means for avoiding, in the course of physiotherapy treatments of a lower limb with a traumatism at knee level, an appreciable loss of the faculty of voluntary extension of the leg resulting from the absence of voluntary muscular work of the thigh muscles.

To this end, the invention proposes a splint structure which, when the treatment or phase of functional reeducation of a traumatised lower limb permits, enables the passive phases of functional reeducation of the knee joint and the active phase of mobilisation to alternate, with a view to urging the muscles of the thigh to work.

The lower limb splint in accordance with the invention, is characterised in that it comprises a support base supporting an articulated assembly, said assembly being constituted by a femoral section and a tibial section articulated to each other, the femoral section being mounted to pivot on the base and the tibial section being carried movably by said base, said articulated assembly being associated with a drive member provoking the relative angular displacement, on the one hand, between the articulated portions and, on the other hand, between these latter and the base.

The invention will be more readily understood on reading the following description with reference to the accompanying drawings, in which:

FIG. 12 is a perspective view illustrating another phase of execution.

FIG. 13 is a perspective view showing another possibility of application.

FIG. 14 is a perspective view showing another phase of execution of the invention according to FIG. 13.

Figure 1:
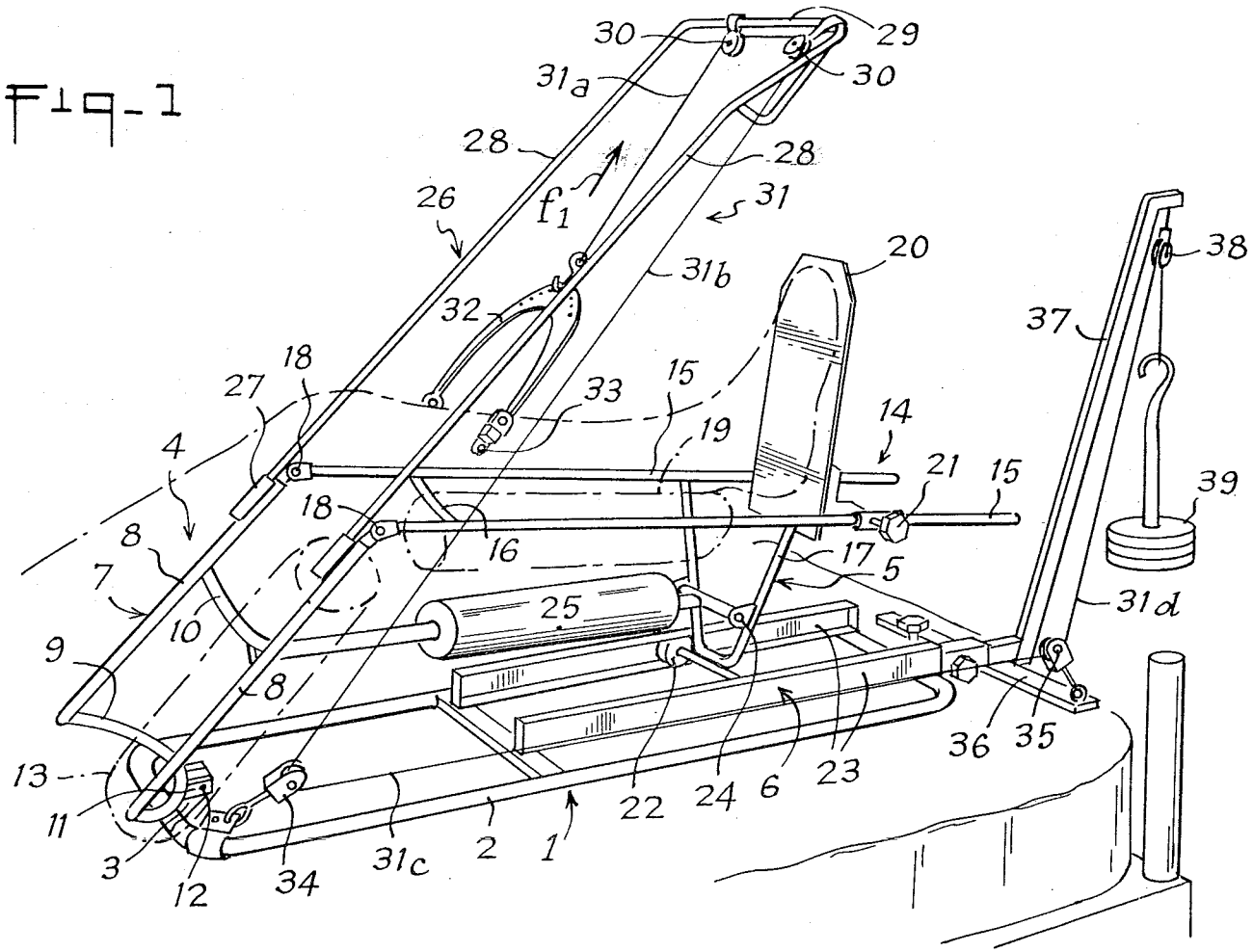
FIG. 1 is a perspective view illustrating the splint of the invention in one embodiment thereof.

Referring now to the drawings, FIG. 1 shows a splint according to the invention, which comprises a base 1 composed of a support plane 2, for example made in the form of a tubular polygon. The plane 2 comprises, in its front part, a lug 3 on which is pivoted an articulated assembly 4 which, moreover, is carried by a chassis 5 cooperating with a support and guide frame 6. The assembly 4 comprises a femoral section 7 constituted by two longitudinal members 8 connected together by crosspieces 9, 10 constituting cradles. Cradle 9 is provided with a fork joint 11 pivoted via a pivot pin 12 on the lug 3. The femoral section 7 may be provided with a hammock 13 made of any suitable material, adapted to be fitted on the longitudinal members 8, so as to constitute a removable cradle for supporting the thigh of a lower limb, such as shown by dashed and dotted lines.

The assembly 4 also comprises a tibial section 14 which is constituted by two longitudinal members 15 connected together by crosspieces 16 and 17 forming cradles. The longitudinal members 15 are connected to the longitudinal members 8 of the femoral section by articulations 18 which materialise the knee joint of the lower limb in the application shown in the drawings.

The tibial section 14 is also provided with a hammock 19, made of any suitable material, forming a removable cradle for supporting the tibia of the lower limb. To improve comfort, the rest and support of the limb may be completed by a sole 20 mounted on the longitudinal members 15 on which it may be adjusted in position via adjusting devices 21.

The cross piece 17 is shaped so as to constitute the chassis 5 at the base of which are mounted two rollers 22 adapted to roll freely in two rails 23 mounted parallel to each other to form the support and guide frame 6. The crosspiece 17 also performs a function of support, via an articulation 24 parallel to the support plane 2, of a drive member 25 connected, furthermore, to the femoral section 7. In the example illustrated, the drive member is constituted by a jack, for example a pneumatic jack, but it is obvious that any other device may be used for the same purpose.

The splint constituted as described hereinabove allows a lower limb to be supported, as illustrated, according to a respective angulation of the different sections corresponding to the relative position occupied by the femoral section 7 and the tibial section 14 connected together by the drive member 25. Consequently, it is possible to control the functioning of the latter in order to modify this angulation and adapt the positioning of the limb as a function of the desired purpose. The splint therefore enables a first function of positioning, according to the desired angulation, to be performed, when the drive member 25 is not employed.

It will be readily understood that it is also possible to modify the angulation of the lower limb resting on the splint, as desired, since it suffices to control the supply of the drive member 25 to modify the relative angulation between the femoral section 7 and the tibial section 14, progressively and alternately, either by providing a manual control of the supply of said drive member 25, or possibly providing an automatic control with end-of-stroke contactors or adjustable inverters.

Consequently, apart from the preceding function, the splint according to the invention also supports a lower limb, whilst enabling its mobilisation at the same time.

According to a further feature of the invention, the splint is also provided with equipment for pulling the limb which it supports. To this end, in the embodiment of FIG. 1, the traction equipment comprises a frame 26 mounted, by longitudinal members 28 which it forms, in two sleeves 27 carried by the femoral section 7. The frame 26 thus extends in line with the femoral section 7 beyond the articulations 18. The longitudinal members 28 are connected together by a crosspiece 29 which supports two pulleys 30 for guiding a traction cable 31 forming a section 31*a* parallel to the longitudinal members and extending between the crosspiece 29 and a stirrup 32 connected for example to a pin 33 implanted in the leg so as to allow a traction in the direction of arrow $f_1$.

As shown in FIG. 1, the frame 26 extends the femoral section 7 in its longitudinal axis and consequently makes it possible to effect a femoral traction, either cutaneous or transosseous by transfemoral or transtibial pin via the cable 31 which is guided, by pulleys 30 outside the splint.

According to a further feature, the cable 31 forms, beyond the pulleys 30, a second section 31*b* extending laterally with respect to the splint up to a guide pulley 34 located substantially in alignment with the pivot pin 12 of the femoral section 7. Beyond the pulley 34, the cable 31 forms a section 31*c* guided parallel to the support plane 2 up to a pulley 35 which is carried by the base 36 of a bracket 37 adjustably adaptable on the rear end of the frame 1 opposite the lug 3. The bracket 37 comprises a guide pulley 38 at the top thereof, ensuring the guide of the section 31*d* of the cable 31 extending from pulley 35 to pulley 38 beyond which the cable 31 is stretched by a traction member 29, for example with passive function, such as a counterweight 39 which is thus outside the useful sphere or volume of the splint.

As shown in the drawings, the splint equipped as described hereinabove, makes it possible, in the case of adaptation shown, to produce a traction along the axis of the femoral diaphysis of the immobilised limb which may be positioned according to the desired relative angulation of its sections by controlling the drive member 25. It is therefore possible, with the splint according to the invention, to provide a concomitant support and traction, offering the possibility, without intervention of the traction circuit, of modifying the positioning of the limb as a function of the desired effect.

The particular design of the traction circuit and the path imposed on the cable 31 via the pulleys are provided for the cable 31 to follow, in all cases, a path parallel to the different main elements constituting the splint and in particular to define between its sections 31*b* and 31*c* a point of flexion centred substantially on the pivot axis 12. Consequently, it becomes possible, if this is desired, to effect a femoral traction and a concomitant mobilisation via the drive member 25 which may be continuously supplied to effect a reciprocal displacement of the femoral section 7 when it is desired, at any stage of consolidation or reeducation, for example, to maintain the limb under traction whilst ensuring a mobilisation of its sections. The possibility offered by the traction circuit is provided so that the concomitant mobilisation does not modify the traction conditions imposed on the limb as the relative angulation changes and, inversely, does not involve an additional load imposed on the drive member 25 by the action of the counterweight 39, as would be the case if the cable 31 followed for example a direct path between the frame 26 and the bracket 37.

Figure 2:
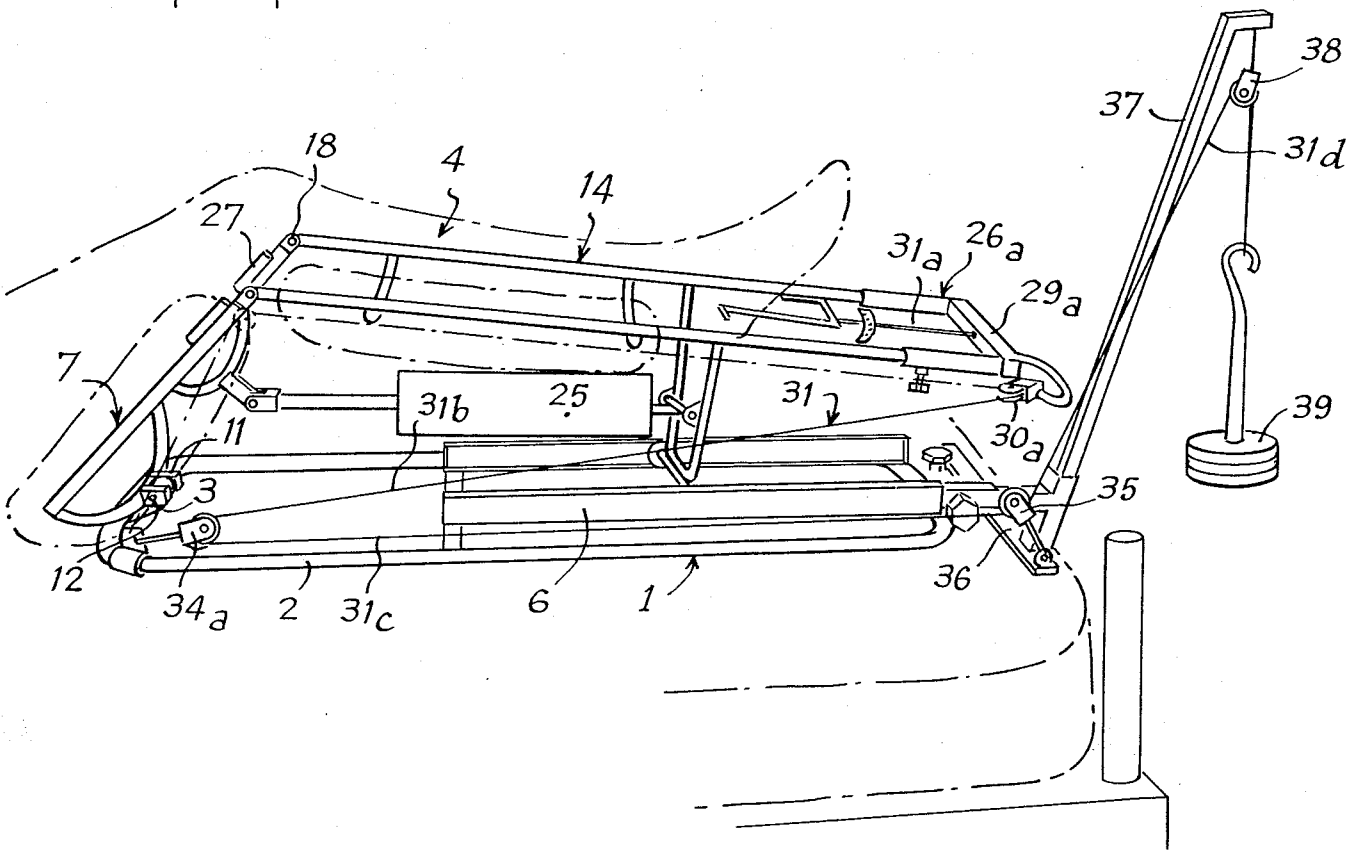
FIG. 2 is another embodiment of the splint, of the invention, also in perspective.

FIG. 2 shows an example of adaptation of the splint according to the invention to a tibial cutaneous traction or one by transcalcaneal pin and, to this end, the traction equipment comprises, in place of the frame 26, a frame 26*a* mounted adjustably at the end of the terminal parts of the longitudinal members 15 of the tibial section 14. The frame 26*a* comprises a crosspiece 29*a* which serves as support and guide for the traction cable 31 forming, as before, the sections 31*a*, 31*b*, 31*c* and 31*d* before reaching pulley 38. As shown by the dashed and dotted lines, an additional guide pulley may be provided in the axis of the articulations 18 so as to cause the cable 31 to follow a path parallel to sections 14 and 7.

As in the preceding example, the splint thus equipped makes it possible to effect a support, mobilisation, traction or possibly a combination of two or more of these functions.

Figure 3:
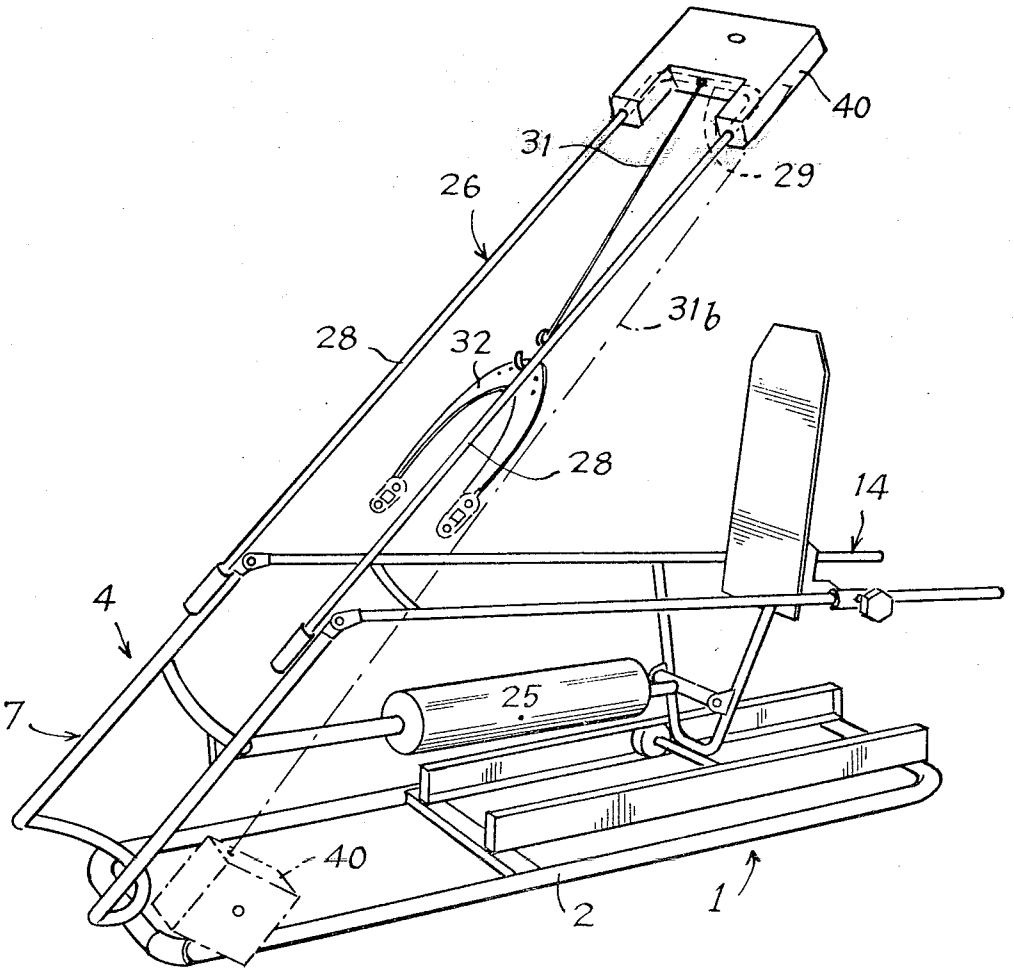
FIGS. 3 and 4 are variant embodiments of FIGS. 1 and 2, respectively.

FIG. 3 shows a variant embodiment in which the support frame 26 of the example of FIG. 1 is equipped at the end, for example at crosspiece 29 level, with a removable adaptation means for a casing 40 containing a cable winding drum. The drum (not shown) is associated with a means for drivng in rotation so as to effect an adjustable tensioning of the cable 31 to perform a function of traction in the axis of the femoral diaphysis in replacement of the permanent action of the counterweight 29. The means for driving in rotation may, as is known, be an elastic means, for example with winding, whose reaction to an initial tensioning may be adjusted by a winding brake or adjustment device to enable the tractive force constantly exerted by the cable 31 to be modified.

FIG. 3 shows that the device 40 provided on the crosspiece 29 then allows a direct traction circuit to be set up. However, it is possible, as shown in this Figure in dashed and dotted lines, to place the device 40 on the femoral section 7 or for example substantially in alignment with the pin 12 so as to produce an indirect traction circuit as in the example of FIG. 1.

Figure 4:
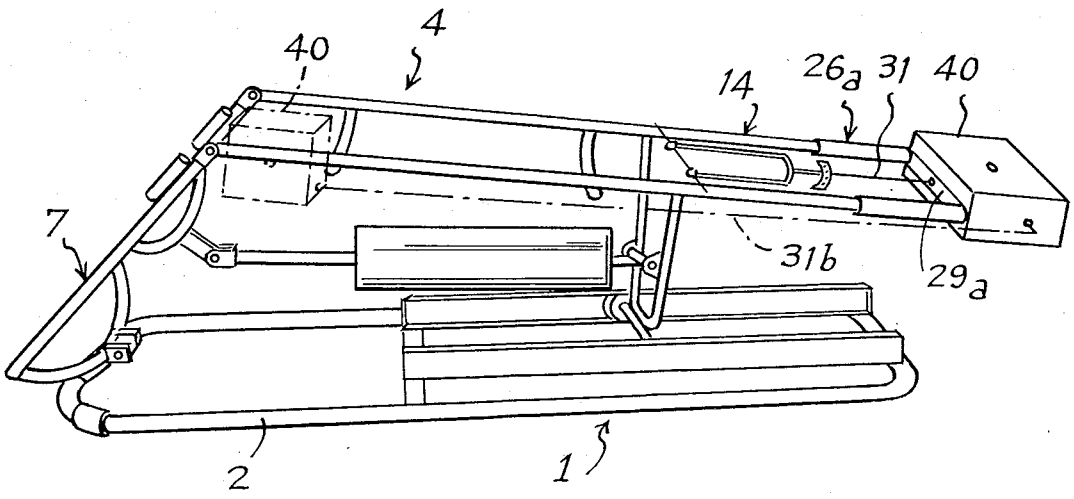

FIG. 4 shows that the winding device 40 may also be adapted as mentioned hereinabove in the case of application of the splint to a transcalcaneal traction concomitant with a support or mobilisation of a limb and that, in such a case, the device may be located equally well at frame 26*a* level or possibly carried by the tibial section 14.

Figures 5, 9:
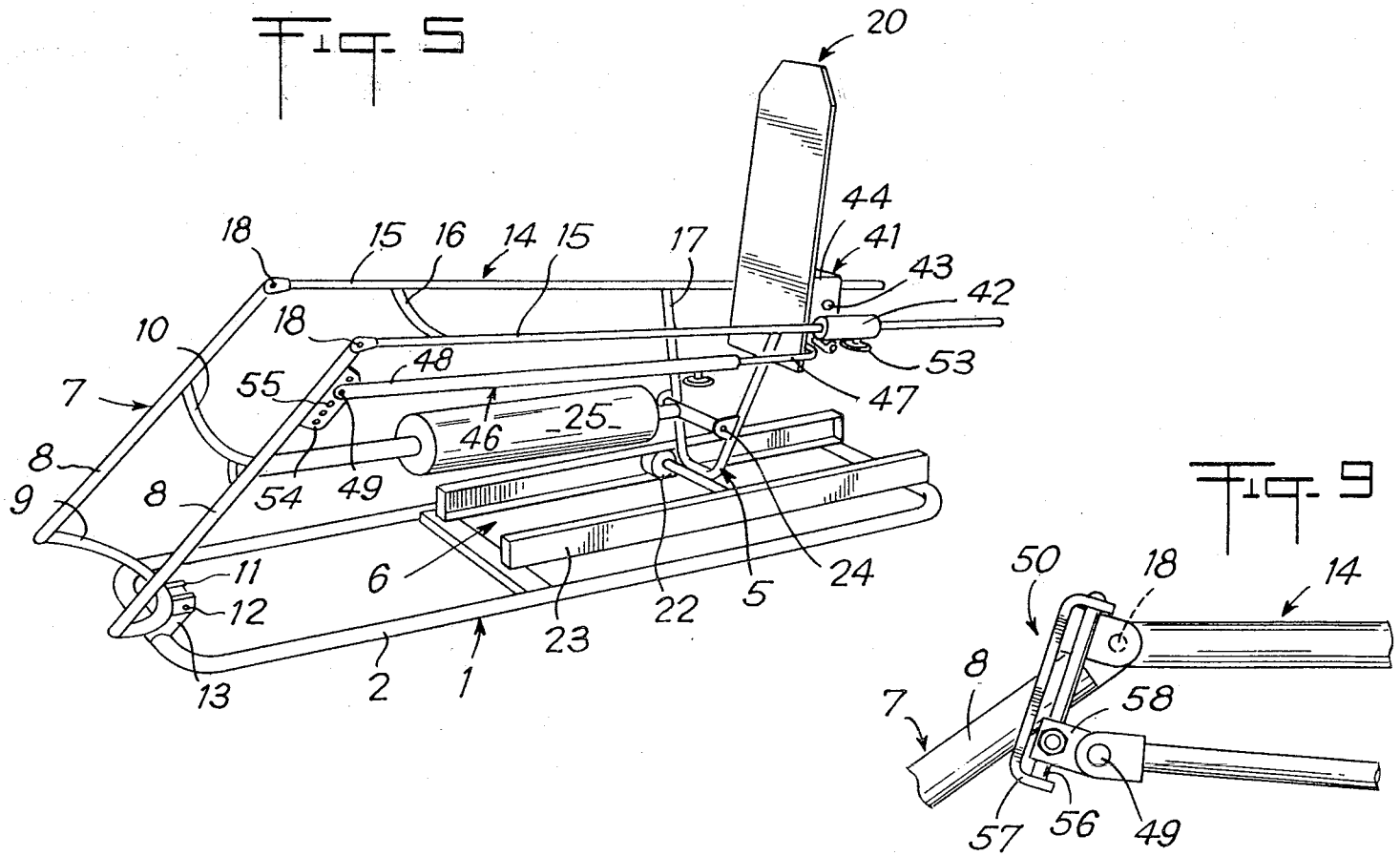
FIG. 5 is a perspective view of another embodiment of a splint for support and mobilisation of a lower limb.
FIG. 9 is a partial side view showing, on a larger scale, a variant embodiment of one of the members of the splint.
Figure 6:
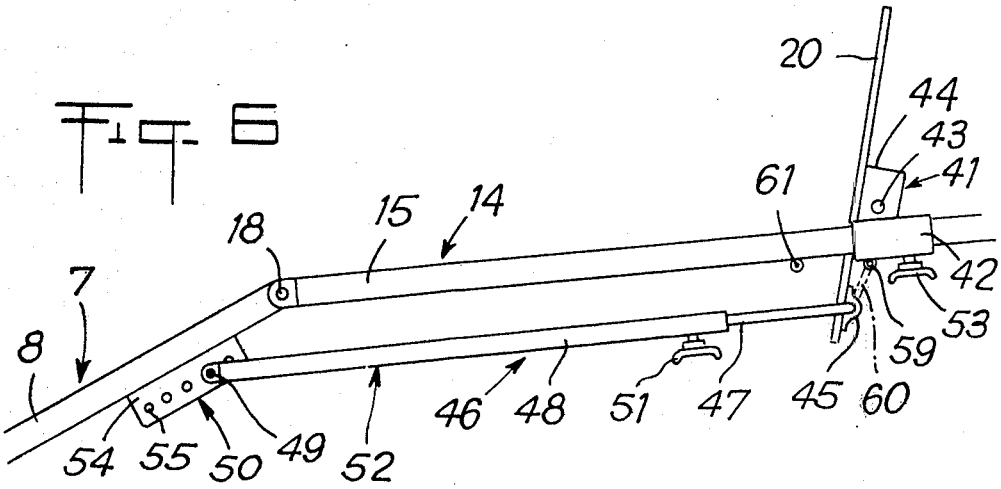
FIG. 6 is a side view showing, on a larger scale, certain characteristic elements of the arrangement of FIG. 5.

FIGS. 5 and 6 show that, according to another embodiment of the invention, the sole 20 is mounted on the longitudinal members 15 via a structure 41 which is constituted by two adjustable sheaths 42 connected together by a crosspiece supporting a pivot pin 43 on which is pivotally mounted a support unit 44 fast with the sole 20. The pivot pin 43 extends parallel to the plane of the longitudinal members 15, being, for example, located approximately in this plane or preferably slightly above it. The lower part of the sole 20 comprises, on its face directed towards the ends of the longitudinal members 15, a bearing 45 which is disposed, when the sole extends perpendicularly to the plane of the longitudinal members 15, below this latter plane. The bearing 45 is provided to establish either an articulated connection, or a fixed connection between the splint and the sole 20.

In the case of an articulated connection, the bearing 45 receives and holds the end of a coupling connection with the section 7. The coupling connection 46 comprises, in the case illustrated, a rod 47 mounted to slide smoothly inside a tube 48 articulated by a pin 49 on a point of support 50 presented by the femoral section 7. The bearing 50 is preferably added along the lower generatrices of one of the longitudinal member 8 of the section 7, so that the tube 48 and the rod 47 extend substantially laterally with respect to the two longitudinal members or, at least, in the vertical plane of the successive longitudinal members 8 and 15 of the two sections. The tube 48 is equipped with a member 51 for immobilising the rod 47 and this member 51 may be constituted for example by a knurled knob acting on a screw intended to abut on the outer peripheral surface of the rod 47.

As shown in FIGS. 5 and 6, the tube 48, the rod 47 and the parts of the sole 20 between the pin 43 and the bearing 45, as well as those of the femoral section between the articulations 18 and 49, define, with the part of the longitudinal member 15 of the section 14 between the articulation 18 and the pin 43, a deformable quadrilateral whose angles are materialised respectively by pin 43, bearing 45, pin 49 and articulation 18. This quadrilateral may either be of any type, or a deformable parallelogram according to whether or not the above-mentioned parts have equal measurements in two's and, for example, depending on the adjustment of extension of rod 47. In the case of it being necessary to effect, at the same time as the mobilisation in flexion-extension of the tibial and femoral sections, a mobilisation of the ankle joint, this adjustment is effected so that, in position of extension, as shown for example in FIG. 7, the foot of the supported limb to be mobilised is placed in a position of an abutment on the sole 20 corresponding to the desired angulation as a function of the conditions of reeducation. Such an adjustment may be modified very easily by acting on the immobilisation member 51 which makes it possible to modify, as desired, in one or the other direction of arrow $f_2$, the relative angulation of the foot in the stable rest position.

Figure 7:
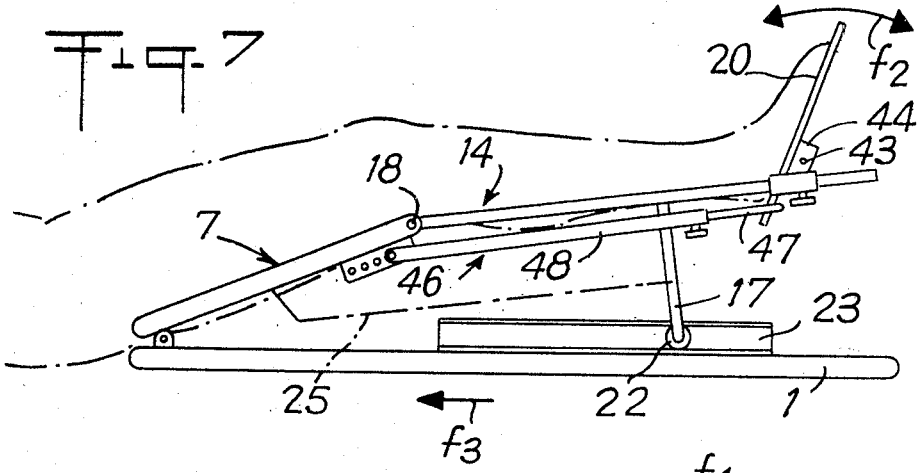
FIGS. 7 and 8 are schematic views illustrating two characteristic positions of functioning of the splint according to FIG. 5.

In the course of a mobilisation phase from the position illustrated in FIG. 7 and in the course of which the drive member 25 controls the relative flexion of the tibial and femoral sections by displacement in the direction of arrow $f_3$, the sections 7 and 14 pivot relatively about the articulations 18.

Figure 8:
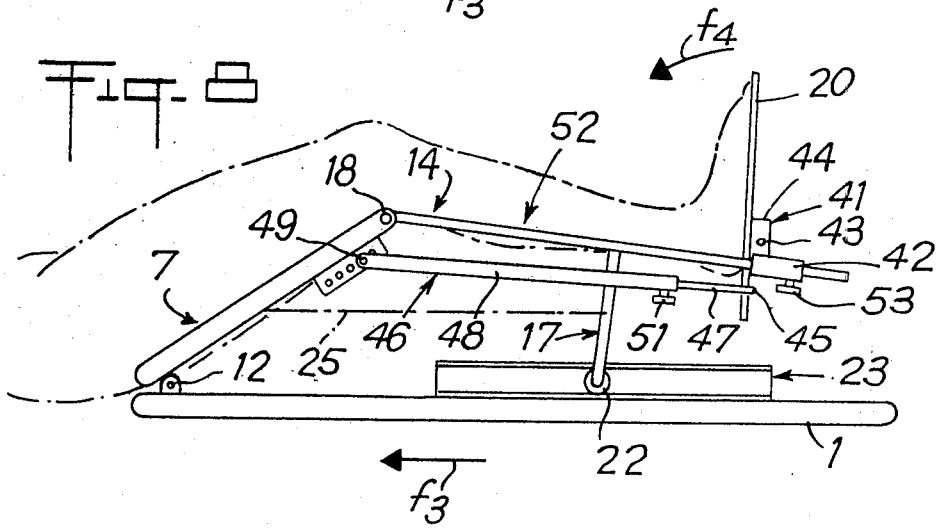

In the course of this displacement (FIG. 8), the deformable quadrilateral 52, whose side between pin 49 and the bearing 45 is longer than that between the articulation 18 and the pin 43, concomitantly subjects the sole 20 to a pivoting in the direction of arrow $f_4$ on the pivot pin 43. It follows that the ankle joint is also subjected to a movement of flexion which is then replaced by a movement of extension when the drive member 25 is supplied to cause the splint, after the desired maximum position of flexion has been attained, to make a stroke of extension during which the deformable quadrilateral 52 acts inversely on sole 20.

The splint according to the invention thus makes it possible to effect, simultaneously, from one control member, the mobilisation of the three joints of a supported lower limb and thus to obtain, if desired, a mobilisation and reeducation of all the joints.

According to the adjustment brought by the immobilisation member 51 to the extension of the rod 47 with respect to the tube 48, it is obviously possible to obtain an angular pivoting of the sole 20 less than, corresponding to or greater than the angle of flexion-extension imposed on the femoral and tibial sections. This presents an important advantage as it becomes possible to choose the amplitude of angular pivoting of the ankle as a function of the phase of reeducation having to be pursued.

The splints of the type described hereinabove offer a possibility of adjusting the position of the sole 20 with respect to the articulations 18 as a function of the length of the tibial section of the limb to be supported and reeducated. This adjustment is effected by means of the knurled knobs 53 carried by the sheaths 42. In order to ensure in all cases the possibility of adjustment of the angle of flexion-extension having to be imposed on the ankle, it is provided to make the point of support 50 in the form of a flat piece or blade 54 presenting a plurality of holes 55 for engagement of pin 49.

According to another constructive arrangement shown in FIG. 9, the point of support 50 is constituted in the form of a guide 56, for example cylindrical, carried by a stirrup shaped element 57 which is fixed laterally to one of the longitudinal members 8 of the femoral section 7. The guide 56 cooperates with a slide 58 mounted to be adjustable in position, particularly via a screw. The slide 58 defines a bearing for receiving the pin 49 for pivoting of the tube 48.

A particularly precise adjustment may be obtained by this means which presents the further advantage of rendering possible the alignment of the axes 18 and 49, by bringing the slide 58 into top position.

It is thus possible to place the slide in such a position that the flexion-extension of the segments 7 and 14 has no influence on the mobilisation of the ankle joint, when, for example, the latter must remain momentarily immobile.

Such a possibility may also be achieved in the embodiment according to FIG. 6, as it suffices to provide one of the sheaths 42 with a bush or a ring 59 for engagement of the curved end of a bar 60, shown in dashed and dotted lines, and engaged by a complementary terminal part in the bearing 45 in which it is axially immobilised. The length of the bar 60 is determined to maintain, in such a case, the sole 20 in an angular position chosen as being the most favourable for the support of the foot, whatever the position occupied by the splint in passive posture or in flexion-extension mobilisation. In such a case, the bar 60 is mounted in the bearing 45 after disengagement of the curved part from the rod 47.

To avoid totally dismantling the tube 48 in such a case of application, it is advantageously provided to equip the corresponding longitudinal member 15 with a ring 61 in which the curved part of the rod 47 may then be placed after the immobilisation member 51 has been manoeuvred to allow a free slide between the rod 47 and the tube 48. This arrangement enables the whole of the splint to be preserved, which may thus be reconstituted in its preceding form of concomitant mobilisation of the three joints of a lower limb, when this is desired.

According to another embodiment of the invention, it is provided to adapt on the above splint an articulated assembly 62 considered as secondary with respect to the articulated assembly formed by sections 7–14. The articulated assembly 62 comprises a femoral cradle 63 shaped to be removably adapted on the femoral section 7 and to extend substantially vertically therefrom. The cradle 63 is preferably constituted in the form of an inverted U whose vertical arms comprise extensions 64 intended to be fitted and fixed inside receiving sheaths 65 which are added to the longitudinal members 8 of the femoral section 7. The sheaths 65 are preferably added on the upper generatrices of the longitudinal members 8 in the vicinity of the articulations 18.

The secondary articulated assembly 62 further comprises a tibial cradle 66 which is provided to extend substantially vertically from the top of the tibial section. To this end, the tibial cradle 66 is constituted substantially in the form of an inverted U whose arms are extended, in a plane substantially perpendicular to the plane of the U, by two longitudinal members 67 adapted to be mounted on the femoral cradle 63 by articulations 68 opposite the extension 64. The articulations 68 thus correspond substantially to the knee joint of a lower limb placed on the splint.

The longitudinal members 67 are shaped or are spaced from each other so that they can at least locally abut on the longitudinal members 15 of the tibial section when the extensions 64 are adapted on the sheaths 65 so that the articulated assembly 62 then rests, in rest state, on the articulated assembly 7–14, the tibial cradle 66 thus being superposed with respect to the tibial section 14.

The articulated assembly 62 further comprises a member 69 for connection with the ankle of a lower limb to be mobilised. The member 69 may be made in several suitable forms and particularly by a bandage, band or strap surrounding the longitudinal members 67 in the manner of a narrow hammock.

Figure 10:
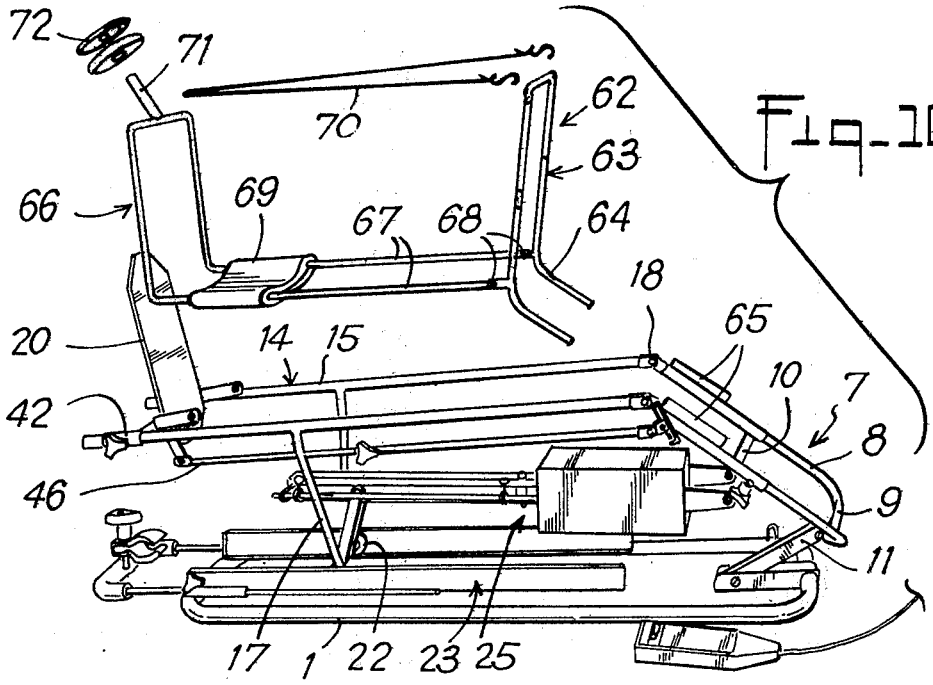
FIG. 10 is an explosed perspective view illustrating a futher embodiment of the invention.

An examination of FIG. 10 will show that the object of the invention may easily be adapted on the splint even when a lower limb is already resting thereon. After the member 69 has been removed, it suffices to adapt the extension 64 in the sheaths 65 to ensure the assembly of the secondary articulated assembly 62 on the splint, as shown in FIG. 11.

If it is desired to reeducate the muscles of the thigh to get back the faculty of extension of the leg, for example, further to a support of the lower limb in a determined position corresponding to a treatment of physiotherapy of the knee joint, there are two possibilities.

Figure 11:
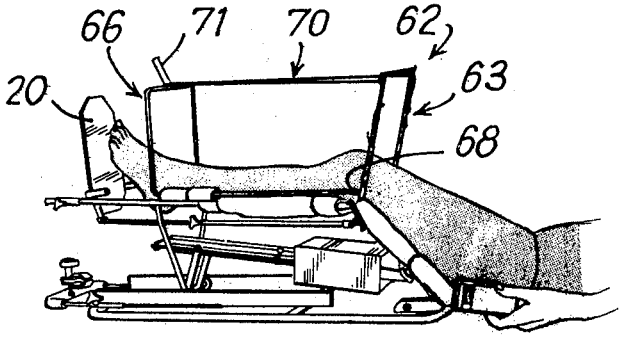
FIG. 11 is a perspective view showing, on a smaller scale, a phase of execution of the embodiment of FIG. 10.

According to the first possibility shown in FIG. 11, the assembly 62 is completed by an elastic member 70, of adjustable force, which is, for example, constituted by a cable whose ends are hooked to the upper transverse part of the femoral cradle 63. The median part of such a cable surrounds a column 71 forming point of anchoring extending from the tibial cradle 66. The force of the elastic member 70 may be adjusted in order, for example, to balance the weight of the leg.

The strap 69 is mounted on the longitudinal members 67 so as to pass under the ankle of the lower limb. In such a position, the weight of the leg maintains the secondary articulated assembly 62 in the position of FIG. 11, i.e. in which the tibial cradle 66 is substantially in abutment on the tibial section 14.

If, in this state, the patient provokes a contraction of the muscles of the thigh with a view to controlling the extension of the leg, such a movement occurs both under the controlled muscular action and under the action of traction of the elastic member 70 which becomes effective as soon as the muscular action brings about a compensation of the weight of the leg. This then results in a pivoting, in the direction of arrow $f_5$, of the tibial cradle 66 lifting with respect to the tibial section 14 by pivoting on the articulations 68 for connection with the femoral cradle 63.

Adjustment of the force of the elastic member 70 therefore allows a possibility of reeducation by active mobilisation added by the relevant muscles of the thigh controlling the extension of the leg. When the patient releases his/her muscular control action, the leg is returned into the original state and tensions the elastic member 70, which opposes a sudden pivoting in opposite direction to the position of return of the tibial cradle 66 in abutment of the tibial section 14.

A second possibility of use is illustrated in FIGS. 13 and 14. According to these Figures, the articulated assembly 62 is without the elastic member 70, but is completed by one or more counterweights 72 mounted on the column 71 of the tibial cradle 66. In such an embodiment, the band 69 is disposed so as to be placed above the ankle of the leg resting on the hammock of the tibial section 4.

To control the movement of extension in the direction of arrow $f_5$ (FIG. 14), the patient is then obliged to urge the muscles of the thigh in question, so as to raise the leg as well as the mobile equipment of the articulated assembly 62 constituted by the tibial cradle 66 and the supplementary mass represented by the or each counterweight 72. Thus, by adjusting the mass of the latter, it becomes possible to employ phases of reeducation in active mobilisation against resistance of the muscles of the thigh in question.

It should be noted that the above-described embodiments concern phases of muscular reeducation of the thigh by dynamic contractions resulting from the movement of extension of the leg. It should be noted that a phase of muscular reeducation by static contractions may also occur, by providing for example to use counterweights 72 so that any attempt at raising is prohibited and consequently only at each stress, a contraction of the muscles of the thigh results without movement of extension of the leg.

What is claimed is:

1. A splint for a lower limb comprising; a base, an assembly having a femoral support member pivoted to said base, a tibial support member pivoted to said femoral support member and having a portion resting on and movable relative to said base, and drive means extending between said femoral support member and said tibial support member for producing relative angular movement between said members and between said members and said base.

2. A splint as defined in claim 1 including a removable extension frame on one of said support members and traction means, including a traction stirrup and a tension filament connected to said stirrup, on said extension frame.

3. A splint as defined in claim 2 wherein said tension filament has a portion extending laterally of and along said one support member and to guide means adjacent the pivot between said assembly and said base.

4. A splint as defined in claim 3 wherein said tension filament extends from said guide means and along said base to a fixed bracket on said base outside the range of movement of said assembly.

5. A splint as defined in claim 1 wherein said tibial support member is provided with a sole plate pivoted thereon on a horizontal axis, said axis being defined by means adjustable along said tibial support member.

6. A splint as defined in claim 5 wherein said tibial support member includes spaced longitudinal members, said horizontal axis being on a crosspiece extending between sleeves embracing and movable along said spaced longitudinal members, and means for locking said sleeves in selected positions along said spaced longitudinal members.

7. A splint as defined in claim 5 including a bearing on said sole plate, spaced from said axis, and adapted to receive a bar to connect said sole plate to said tibial support member and thereby lock said sole plate from pivoting about said axis.

8. A splint as defined in claim 5 including a bearing on said sole plate spaced from said axis; an elongated coupling member engaged in said bearing and pivoted to said femoral support member for swinging said sole plate about said axis in response to relative pivotal movement between said femoral support member and said tibial support member.

9. A splint as defined in claim 8 wherein said elongated coupling member is of at least two pieces selectively adjustable relative to each other in a longitudinal direction to adjust the length of said coupling member.

10. A splint as defined in claim 8 wherein the position of the pivotal connection between said coupling member and said femoral support member is adjustable relative to the latter to selectively adjust the distance of said pivotal connection from the pivot joining said femoral support member to said tibial support member.

11. A splint as defined in claim 1 including a secondary articulated assembly of a femoral support cradle carried by said femoral support member and pivoted to a tibial support cradle, said tibial support cradle being in the form of spaced longitudinal members adapted to at least partly rest on the tibial support member, and at least one support strap on said tibial support cradle arranged to engage the ankle of a leg on said splint.

12. A splint as defined in claim 11 wherein the axis of the pivot between said femoral support cradle and said tibial support cradle is substantially aligned with the knee joint of a leg resting on said splint.

13. A splint as defined in claim 11 wherein said femoral support cradle includes a pair of extensions removably mounted in receiving sheaths on said femoral support member.

14. A splint as defined in claim 11 including at least one elastic member extending between a portion of said femoral support cradle and said tibial support cradle and so positioned relative to said cradles as to tend to raise said tibial support cradle relative to said femoral support cradle and member.

15. A splint as defined in claim 11 including counterweight means carried by said tibial support cradle and arranged thereon to oppose lifting of a leg on said splint, by pressing said support strap downwardly on the ankle of a leg on said splint.

* * * * *

REEXAMINATION CERTIFICATE (377th)

United States Patent [19]

Pécheux

[11] B1 4,323,060

[45] Certificate Issued Sep. 3, 1985

[54] SPLINT

[75] Inventor: Jean-Claude R. Pécheux, Charleville-Mézières, France

[73] Assignee: Societe Anonyme: Compagnie Generale De Materiel Orthopedique, Charleville-Mézières, France

Reexamination Request:
No. 90/000,445, Sep. 16, 1983

Reexamination Certificate for:

| | |
|---|---|
| Patent No.: | **4,323,060** |
| Issued: | **Apr. 6, 1982** |
| Appl. No.: | **141,405** |
| Filed: | **Apr. 18, 1980** |

[30] Foreign Application Priority Data

Apr. 23, 1979 [FR] France ..... 79 11181
Nov. 5, 1979 [FR] France ..... 79 27622

[51] Int. Cl.[3] ..... A24C 5/18
[52] U.S. Cl. ..... 128/84 R; 128/75
[58] Field of Search ..... 128/84, 84 C, 85, 68, 128/71, 75

[56] References Cited

U.S. PATENT DOCUMENTS

| | | | |
|---|---|---|---|
| 1,879,001 | 9/1932 | Allen . | |
| 2,101,889 | 12/1937 | Anderson . | |
| 2,152,431 | 3/1939 | Jensen . | |
| 2,266,628 | 12/1941 | Finochietto | 128/84 |
| 2,614,588 | 10/1952 | Lovell | 128/37 |
| 2,763,261 | 9/1956 | Masmonteil | 128/33 |
| 3,039,456 | 6/1962 | Luce | 128/25 |
| 3,060,926 | 10/1962 | May | 128/25 |
| 3,066,322 | 12/1962 | Derby | 5/327 |
| 3,450,132 | 6/1969 | Ragon et al. | 128/25 |
| 3,472,222 | 10/1969 | Aplin | 128/25 |
| 3,616,795 | 11/1971 | Powlan | 128/85 |
| 3,661,150 | 5/1972 | Peterssen et al. | 128/85 |
| 3,717,144 | 2/1973 | Bimler | 128/80 A |
| 3,765,411 | 10/1973 | Ward | 128/84 C |
| 3,976,057 | 8/1976 | Barclay | 128/25 R |
| 4,089,330 | 5/1978 | Nicolosi et al. | 128/25 R |

FOREIGN PATENT DOCUMENTS

| | | |
|---|---|---|
| 641430 | 12/1963 | Belgium . |
| 297482 | 8/1915 | Fed. Rep. of Germany . |
| 522975 | 2/1930 | Fed. Rep. of Germany . |
| 671580 | 1/1939 | Fed. Rep. of Germany . |
| 824376 | 11/1951 | Fed. Rep. of Germany . |
| 849167 | 7/1952 | Fed. Rep. of Germany . |
| 869387 | 3/1953 | Fed. Rep. of Germany . |
| 919428 | 9/1954 | Fed. Rep. of Germany . |
| 2524468 | 9/1976 | Fed. Rep. of Germany . |
| 718055 | 1/1932 | France . |
| 1493999 | 7/1967 | France . |
| 2085118 | 12/1971 | France . |
| 2295726 | 7/1976 | France . |
| 430046 | 8/1967 | Switzerland . |
| 112812 | 1/1918 | United Kingdom . |
| 159422 | 3/1921 | United Kingdom . |
| 371571 | 4/1932 | United Kingdom . |
| 1334115 | 10/1983 | United Kingdom . |

OTHER PUBLICATIONS

"Attelle Motorisee 3040-Kinetic", Nov. 1978.
"Attelle Motorisee 3020-Kinetic", Apr. 24, 1979.

*Primary Examiner*—Stephen C. Pellegrino

[57] ABSTRACT

The present invention relates to orthopaedic equipment, and particularly a splint, comprising an articulated assembly associated with a drive member for provoking the relative angular displacement, on the one hand, between articulated sections constituting the assembly and, on the other hand, between said assembly and a support frame, at least one of the sections being extended by a frame supporting an independent traction equipment comprising a traction member, a traction circuit and a traction stirrup. The invention is more particularly applicable to the reeducation of lower limbs.

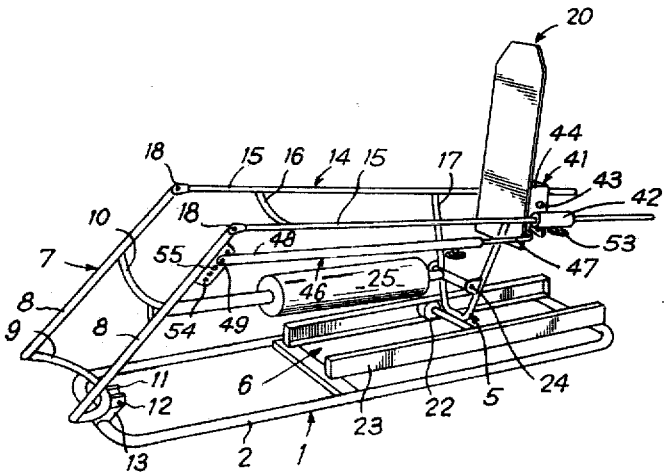

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5 and 8 are cancelled.

Claims 1, 2, 6, 7, 9 and 10 are determined to be patentable as amended.

Claims 3, 4, and 11–15, dependent on an amended claim, are determined to be patentable.

New claims 16–27 are added and determined to be patentable.

1. A *portable* splint *which is articulated and automatically movable* for *passive exercising of* a lower limb comprising: a base *adapted to sit on a surface where the lower limb is located*, an assembly having a femoral support member pivoted to said base, a tibial support member pivoted to said femoral support member and having a portion resting on and movable relative to said base, and drive means extending between said femoral support member and tibial support member *and located above said surface, and means for connecting the drive means to said assembly* for producing relative angular movement between said members and between said members and said base[.], *said tibial support member being provided with a sole plate pivoted thereon on a horizontal axis, bearing means on the sole plate, a coupling member connected between said bearing means and said femoral support member for pivoting said sole plate about said axis in response to relative pivotal movement between said femoral support member and said tibial support member.*

2. A *portable* splint as defined in claim 1 including a removable extension frame *mounted* on *and longitudinally aligned with* one of said support members and traction means, including a traction stirrup and a tension filament connected to said stirrup, on said extension frame.

6. A splint as defined in claim [5] *1* wherein said tibial support member includes spaced longitudinal members, said horizontal axis being on a crosspiece extending between sleeves embracing and movable along said spaced longitudinal members, and means for locking said sleeves in selected positions along said spaced longitudinal members.

7. A splint as defined in claim [5] *1* including a bearing on said sole plate, spaced from said axis, and adapted to receive a bar to connect said sole plate to said tibial support member and thereby lock said sole plate from pivoting about said axis.

9. A splint as defined in claim [8] *1* wherein said [elongated] coupling member is of at least two pieces selectively adjustable relative to each other in a longitudinal direction to adjust the length of said coupling member.

10. A splint as defined in claim [8] *1* wherein the position of the pivotal connection between said coupling member and said femoral support member is adjustable relative to the latter to selectively adjust the distance of said pivotal connection from the pivot joining said femoral support member to said tibial support member.

*16. A portable splint as defined in claim 1, and further including locking means for selectively locking and unlocking the sole plate relative to the horizontal axis, and disabling means for selectively disabling the coupling member when the locking means is locked.*

*17. A portable splint as defined in claim 16, wherein the disabling means includes means for disconnecting the coupling member from the bearing means and connecting said coupling member to the tibial support member and means for allowing the coupling member to vary in length during the pivotal movement between the tibial and femoral support members.*

*18. A splint for a lower limb comprising:*

*a base;*

*an assembly having a femoral support member pivoted to said base;*

*a tibial support member pivoted to said femoral support member and having a portion resting on and movable relative to said base;*

*drive means extending between said femoral support member and said tibial support member for producing relative angular movement between said members and between said members and said base;*

*a sole plate pivotally mounted on a horizontal axis on said tibial support member;*

*bearing means on said sole plate;*

*an elongated coupling member engaged to said bearing means and pivoted to said femoral support member for swinging said sole plate about said axis in response to relative pivotal movement between said femoral support member and said tibial support member.*

*19. A splint as defined in claim 18, wherein said elongated coupling member is of at least two pieces selectively adjustable relative to each other in a longitudinal direction to adjust the length of said coupling member.*

*20. A splint as defined in claim 18, wherein the position of the pivotal connection between said coupling member and said femoral support member is adjustable relative to the latter to selectively adjust the distance of said pivotal connection from the pivot joining said femoral support member to said tibial support member.*

*21. A splint for a lower limb comprising:*

*a base;*

*an assembly having a femoral support member pivoted to said base;*

*a tibial support member pivoted to said femoral support member and having a portion resting on and movable relative to said base;*

*drive means extending between said femoral support member and said tibial support member for producing relative angular movement between said members and between said members and said base;*

*a secondary articulated assembly of a femoral support cradle carried by said femoral support member and pivoted to a tibial support cradle, said tibial support cradle being in the form of spaced longitudinal members adapted to at least partly rest on the tibial support member; and*

*at least one support strap on said tibial support cradle arranged to engage the ankle of a leg on said splint.*

*22. A splint as defined in claim 21, wherein the axis of the pivot between said femoral support cradle and said tibial support cradle is substantially aligned with the knee joint of a leg resting on said splint.*

*23. A splint as defined in claim 21, wherein said femoral support cradle includes a pair of extensions removably mounted in receiving sheaths on said femoral support member.*

*24. A splint as defined in claim 21, including at least one elastic member extending between a portion of said femoral support cradle and said tibial support cradle and so positioned relative to said cradles as to tend to raise said tibial support cradle relative to said femoral support cradle and member.*

*25. A splint as defined in claim 21, including a counterweight means carried by said tibial support cradle and arranged thereon to oppose lifting of a leg on said splint by pressing said support strap downwardly on the ankle of a leg on said splint.*

*26. The splint of claim 1 or 18, and further including means for movably adjusting said axis along the tibial support member.*

*27. The splint of claim 1 or 18, wherein the bearing means on said sole plate is spaced from said axis.*

* * * * *